US006840706B1

(12) United States Patent
Camomilla et al.

(10) Patent No.: US 6,840,706 B1
(45) Date of Patent: Jan. 11, 2005

(54) MULTIPURPOSE ROAD BARRIER, HAVING A DOUBLE DAMPENING-RESISTANT EFFECT

(75) Inventors: Gabriele Camomilla, Rome (IT); Stefano Bruschi, Rome (IT)

(73) Assignee: Autostrade Concessioni e Costruzioni Autostrade S.p.A., Rome (IT)

( * ) Notice: Subject to any disclaimer, the term of this patent is extended or adjusted under 35 U.S.C. 154(b) by 0 days.

(21) Appl. No.: 10/031,576

(22) PCT Filed: Jun. 15, 2000

(86) PCT No.: PCT/IT00/00248

§ 371 (c)(1),
(2), (4) Date: Jan. 22, 2002

(87) PCT Pub. No.: WO01/06063

PCT Pub. Date: Jan. 25, 2001

(30) Foreign Application Priority Data

Jul. 21, 1999 (IT) ..... RM99A0464

(51) Int. Cl.[7] ..... E01F 15/00
(52) U.S. Cl. ..... 404/6; 256/13.1
(58) Field of Search ..... 404/6, 10; 256/13.1

(56) References Cited

U.S. PATENT DOCUMENTS

| | | | | | |
|---|---|---|---|---|---|
| 1,718,875 | A | * | 6/1929 | Ramsey | 256/13.1 |
| 3,332,666 | A | * | 7/1967 | Gray | 256/13.1 |
| 3,385,564 | A | * | 5/1968 | Persicke | 256/13.1 |
| 3,712,589 | A | * | 1/1973 | Peterson et al. | 256/13.1 |
| 3,844,538 | A | | 10/1974 | Colan | |
| 4,681,302 | A | | 7/1987 | Thompson | |
| 5,123,773 | A | | 6/1992 | Yodock | |
| 5,137,391 | A | * | 8/1992 | Ballesteros | 404/6 |
| 5,697,728 | A | * | 12/1997 | Camomilla et al. | 404/6 |
| 5,836,714 | A | * | 11/1998 | Christensen | 404/6 |
| 5,851,005 | A | * | 12/1998 | Muller et al. | 256/13.1 |
| 6,086,285 | A | * | 7/2000 | Christensen | 404/6 |
| 6,149,134 | A | * | 11/2000 | Bank et al. | 256/13.1 |
| 6,276,667 | B1 | * | 8/2001 | Arthur | 256/13.1 |
| 6,533,250 | B2 | * | 3/2003 | Arthur | 256/13.1 |
| 6,533,495 | B1 | * | 3/2003 | Williams et al. | 404/6 |

FOREIGN PATENT DOCUMENTS

| | | |
|---|---|---|
| BE | 644358 | 9/1964 |
| DE | 1 534 499 | 6/1969 |
| DE | 2 200 183 | 7/1973 |
| DE | 7420685 | 10/1974 |
| DE | 25 13 436 | 10/1975 |
| EP | 0 518 304 A1 | 12/1992 |
| GB | 1 347 771 | 2/1974 |
| JP | 2-157308 | 6/1990 |
| WO | WO 95/03453 | 2/1995 |

* cited by examiner

*Primary Examiner*—Gary S. Hartmann
(74) *Attorney, Agent, or Firm*—Young & Thompson

(57) ABSTRACT

Road safety barrier includes a resistant part and one or two dampening parts for a lateral barrier or a traffic divider respectively. The resistant part of the wall type barrier may be rigidly connected to steel plates which are equally spaced and have been specifically conceived for increasing the resistance during an impact caused by a heavy vehicle. The plates have a slot for the passage of ductile screw anchors, allowing the initial displacement of the resistant part and its connection to the support. If provided, the ductile anchor parts are covered by the dampening part.

4 Claims, 7 Drawing Sheets

MULTIPURPOSE ROAD BARRIER, HAVING A DOUBLE DAMPENING-RESISTANT EFFECT

TECHNICAL FIELD

The present invention relates to a multipurpose road safety barrier, that is, to a barrier adaptable for being used on the side of a bridge, or as lateral barrier, or as a traffic divider, and which can also be utilized (provided it is appropriately modified) as a support for a sound proofing screen or a screen for protection against the throw of objects. The barrier may be subjected to type approval in various classes corresponding to different resistances, up to the one corresponding to the maximum resistance (H4).

The barrier allows to dampen the collision, by way of a controlled deceleration, in case of light motorcars, while stopping the motion of heavy vehicles.

BACKGROUND ART

Road barriers of the wall kind and having a New Jersey (NJ) profile, which are made of monolithic blocks of concrete and which, after their assembling, give rise to a high quality protection, are already known in the art. In those barriers the calibration of the deceleration is obtained, in case of motorcars and generally of light vehicles, by means of the lifting of the vehicle due to the New Jersey shape, and at the same time, due to the presence of sliding shoes, if any, which facilitate the displacement of the barrier and which are interposed between the barrier and its support. Therefore, if the impact angle is restricted, the motorcar is again deviated towards the carriageway, whereas, if it is noticeable, the sliding shoes will promote the displacement of the barrier and calibrate the deceleration values, as mentioned above.

The barriers of the wall type, even if provided with slide facilitating devices (shoes) acting during part of the maximum allowable displacement, as disclosed in some patent applications of the same applicant, and even if provided with a projecting socle (base) having a New Jersey profile or a different configuration, always give rise to a deceleration caused by the collision, and to relevant components of the same in the longitudinal, transversal, and vertical direction with respect to the direction of motion.

In particular, the vertical component is very strong for those types of barriers, and also the transversal component is usually of an impulsive nature (the longitudinal component is more distributed in time). The first of these components has a beneficial effect on the dissipation of kinetic energy of motorcars, since it converts the same into potential energy (lifting), which will be returned after some time, but its generation must not occur simultaneously to that of the transversal impulsive component, because otherwise both components contribute simultaneously to the amount of acceleration given by the ASI (Acceleration Severity Index), the latter being used during type approval tests for the evaluation of the maximum admissible energy to which the passengers of the motorcar may be subjected, under standard extreme conditions of type tests for road barriers.

"U.S. Pat. No. 4,681,302 discloses a barrier for dissipating kinetic energy upon impact by a moving vehicle. The barrier modules may be filled with water to increase their weight and they are resiliently deformable to return to their original shape after being struck.

The barrier disclosed in this document, may form a traffic divider and it captures the vehicle tire, tending to slow the tire and preventing it from climbing and the vehicle from vaulting.

This kind of barrier includes also traction spoiler channels to reduce the area of contact between the barrier and the tires of a vehicle.

While this patent U.S. Pat. No. 4,681,302 already contains the idea of realising a deformable barrier, this barrier does not allow the wheel to climb, so as to convert part of the vehicle kinetic energy into potential energy. Moreover, this barrier is not resistant enough to be used as a "bivalent barrier", that is a barrier stopping heavy vehicles as well as light vehicles.

Therefore, although it may be very useful in certain cases, it does not belong to the same category of barriers as those of the present invention, and consequently it does not achieve the objects of the present invention."

DISCLOSURE OF INVENTION

An object of the present invention is to shift in time the occurrence of the transversal acceleration with respect to the occurrence of the vertical acceleration, so that they will not add at the same time.

Another object of the invention is to further "dilute" in time the transversal component, which—as mentioned above—has an impulsive nature.

A third object of the invention is to realize barriers whose resistance may be approved during type tests and be assigned, according to the embodiment in question, to any of the classes H2 to H4.

A fourth object of the invention is to provide a modular type barrier, in order to reduce to a minimum the operations to be carried out on existing infrastructures, and reducing at the same time the risk of accidents during the laying, while obtaining an optimization of production costs.

A fifth object of the present invention, depending on the preceding one, is to realize a barrier made of monolithic blocks and modules which can be directly connected to one another with a minimum laying time and are adaptable to any kind of road structure.

A further object is to include in the barrier typology of the present invention, all particular constructive means which are already used in this technical field, like longitudinal connection bars between modules, which are made of special materials with a controlled ductility, or ductile screw anchors having a predetermined resistance to breakage, and possibly friction reducing shoes, thereby increasing the system reliability.

According to the invention, the innovative barrier obtains the dampening of the collision caused by a light vehicle, in a more effective way with respect to the known art, by dividing up the "small wall" formed by a traditional barrier, into two elements, a resistant one (hereinafter called element A) and a dampening one (hereinafter called element B).

It should be noted that the dampening element B always faces the carriageway, and is located in front of the resistant element A.

A symmetric single-row traffic divider will then be formed by two elements B located on both sides of the central resistant element A.

In case of a barrier used for the side of a bridge or of a lateral barrier, which is asymmetric, there will be only a single dampening element B and a rear resistant element A.

The element B is located at the foot of the element A, so as to form a monolithic socle extending along the whole length of the element A (which is itself monolithic).

The element A serves for stopping—in case of low energy impacts—the displacement of the other (front) element B, whose purpose is instead to receive and absorb a first part of the impact energy of a goods vehicle or the whole amount of impact energy of a light motorcar; the dampening of this energy will occur according to multiple processes described later on, related to the deformability of the element B, and/or to the interposition of dissipating material between the two elements A and B, and/or to the kind of connection of the front element B with respect to the support, by means of calibrated friction (shoes), or to the connection with the second resistant element A, through anchor means and/or mutually fitted parts (restricted joints).

The barrier, depending on its use, will be;

symmetric, that is with two dampening elements on both sides of the resistant element;

asymmetric, that is with a single dampener on the side of the possible impact.

The form of the dampening element B corresponds in general to the shape of a socle, which complements the shape of the rear element A, so that, in case one intends to realize an NJ barrier, the barrier (A plus B) will assume the shape of a traditional New Jersey barrier. In general, the socle may have a shape different from that of an NJ profile, e.g. the shape may be rounded, elliptical, etc., provided it is suited for the intended purposes. The overall profile of the barrier will be defined by the profile of both elements A and B.

By the introduction of a deformable element at the "wall" base, it is possible to obtain the following:

a dilution in time of the transversal component, which will have a more gradual peak increase;

a postponement of the time the vehicle starts climbing on the socle B, because the latter deforms itself before allowing the vehicle to ascend, thereby giving rise to a noticeable (or maximum) value of vertical acceleration a fraction of a second later than the increase of the first (transversal) component.

The use of appropriate anchor means, together with the resistant element A, of an (energy) dissipating material—if any—interposed between the elements A and B, and of the deformable material making up the socle B, will serve for the purpose of a better calibration of the described operation.

This aspect of the invention relates to the control (calibration) of light impacts; for what concerns higher energy impacts, up to the maximum energy contemplated by the rules on type approval, the resistance will be provided by the resistant element, whose height, transversal dimension, and specific weight, may be arbitrarily chosen, depending on the function of the barrier (safety and screen function, or only safety). The resistant element A can be made of concrete, including an internal reinforcement, or by other materials, e.g. steel of suitable sheet thickness, whereas the dampening element may be made of plastics, steel, or possibly of concrete, but in the latter case an energy dissipating material will be interposed between elements A and B.

In case the socle B is manufactured using plastics, it is possible to employ a reticular, honeycomb, or hollow structure, or a structure filled with water and an antifreeze.

BRIEF DESCRIPTION OF DRAWINGS

The present invention will now be described in more detail by means of some examples of certain specific embodiments thereof, given by way of example only, and not for limiting purposes, said embodiments being shown in the annexed drawings, in which.

MODES FOR CARRYING OUT THE INVENTION

Figure 1A:
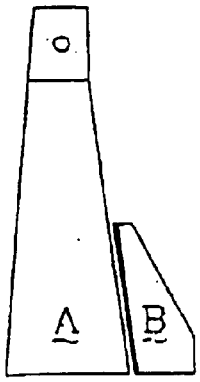
FIG. 1*a* schematically shows a cross section of an asymmetric, double effect, New Jersey type barrier, according to the present invention, comprising a resistant and a dampening element.
Figure 1B:
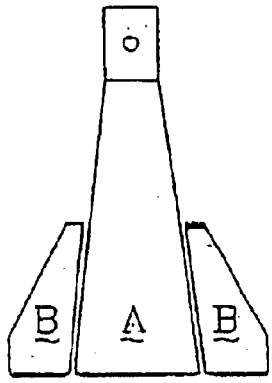
FIG. 1*b* schematically shows a cross section of a symmetric double effect and single-row type barrier (traffic divider), according to the present invention, including two elements B.

FIGS. 1*a* and 1*b* are schematic views of barrier typologies, showing how the barrier of the invention comprises a resistant element A and a dampening element B (in case of an asymmetric barrier for the side of a bridge or of a lateral barrier), or respectively, two dampening elements B (in case of a symmetric single-row type traffic divider). Obviously, the constructive details will be explained in the following description, with reference to the corresponding figures. Moreover, it should be clear that the socle B, while having a shape of a New Jersey socle in FIGS. 1*a* and 1*b*, will have—as may be seen also in the following Figs.—a different shape according to particular requirements and to the desired ASI value of the impact deceleration.

Figure 2A:
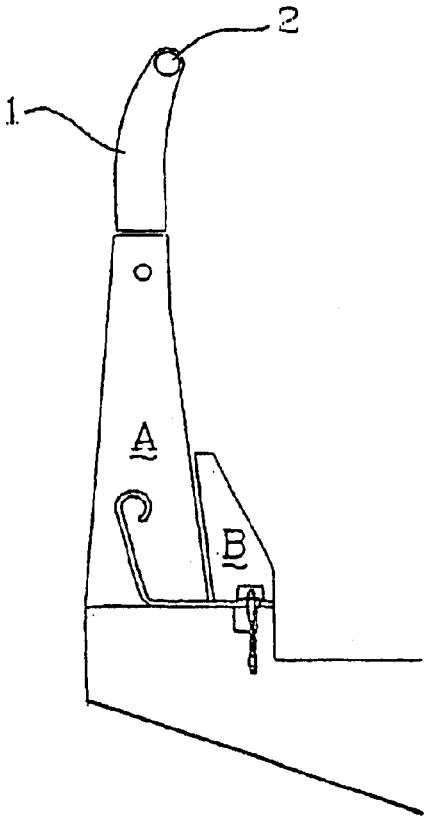
FIG. 2*a* is a cross section of a possible embodiment of an anchored asymmetric barrier, according to the invention, acting as a guard (parapet)
Figure 2B:
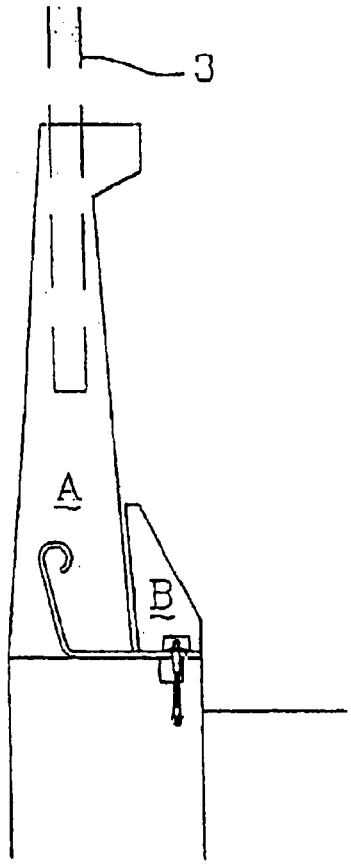
FIG. 2*b* is a cross section of an embodiment of an asymmetric barrier anchored to the curbstone, acting as a guard and screen.
Figure 20:
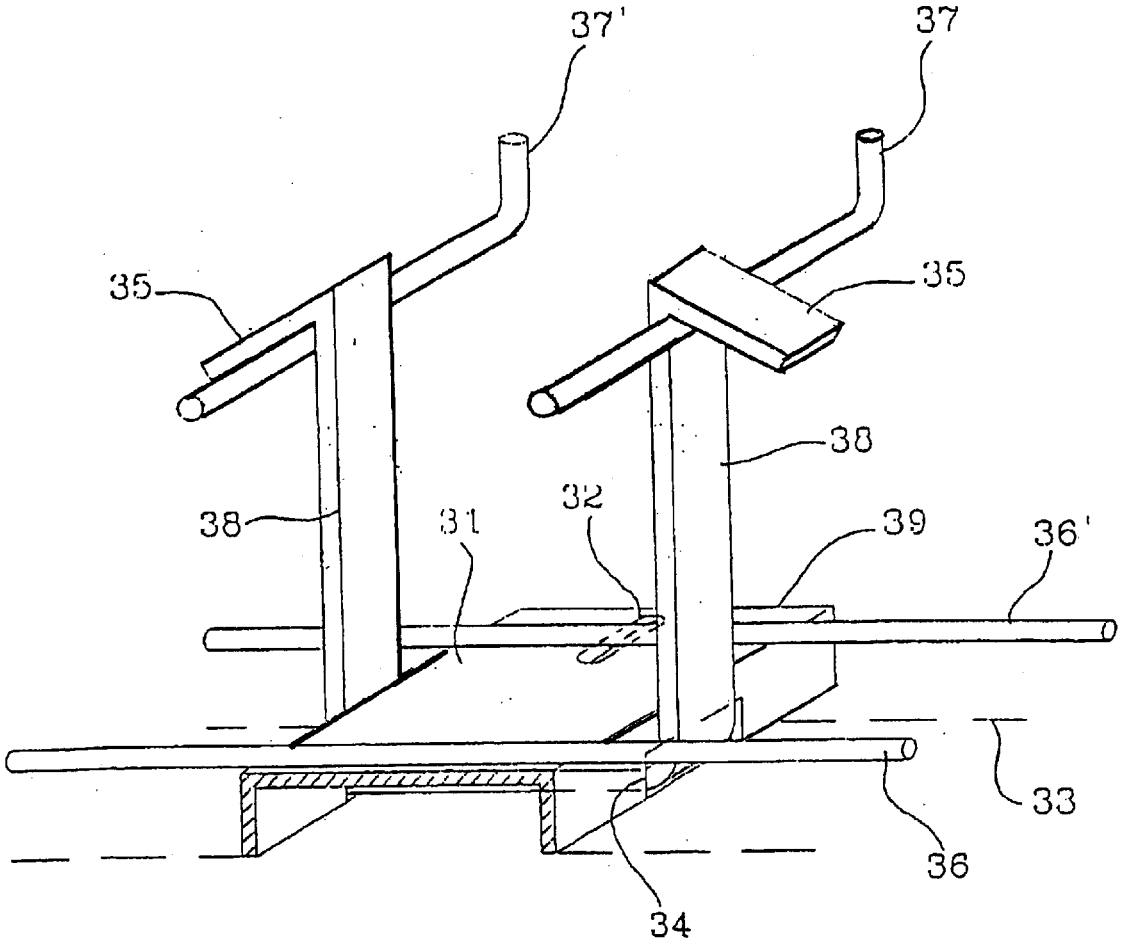
FIGS. 20, 21, 22 are perspective and cross sectional views of two specific anchor systems, which are embedded inside the material making up the resistant element A, and which provide for a movable and ductile anchor system relative to the support, by means of special screw anchors.
Figure 21:
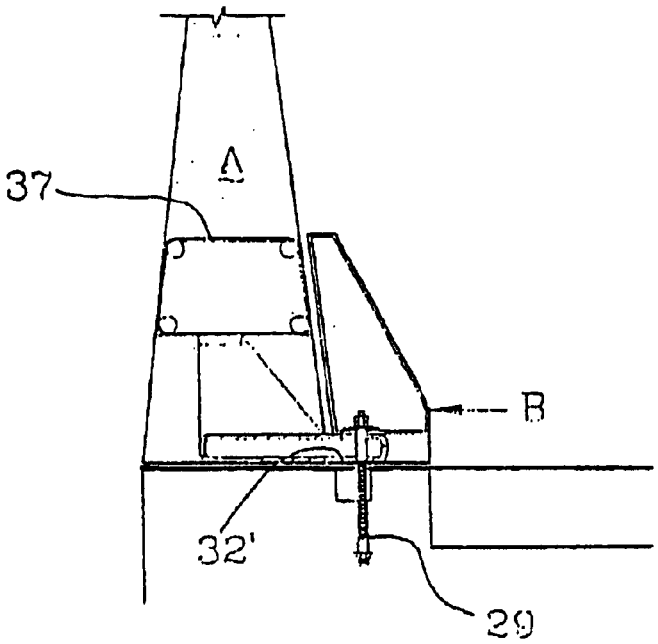
Figure 22:
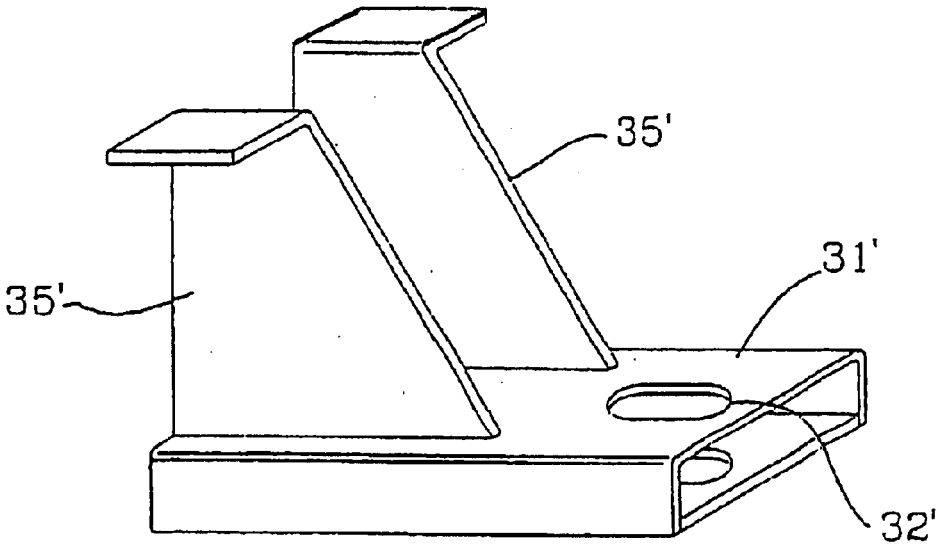

FIGS. 2*a* and 2*b* show how the resistant element may be anchored to the curbstone using means known in the art (ductile screw anchors with a predetermined threshold of breakage), and as illustrated in more detail in the description of FIGS. 20, 21, 22. Should the dampening or absorbing effect produced by the elements B be insufficient, no limitations would exist to the addition of friction reducing shoes, which are already known from some patent applications of the same applicant, filed before the present one.

Said friction reducing shoes will be disposed below the socle B or below the resistant element A (see FIG. 20 and the related description for the latter case). The shoes could—possibly—be used in case of a concrete made socle, in the embodiment interposing dampening elements between the two elements A, B, in order to reduce friction between the socle and its supporting surface.

In FIGS. 2*a* and 2*b* the number 1 denotes the handrail support of the handrail 2, whereas the number 3 denotes a screen supported by the element A, which has appropriate dimensions. The screen may be a protection net against the throw of objects, a windscreen, a soundproof screen, etc.

Figure 3:
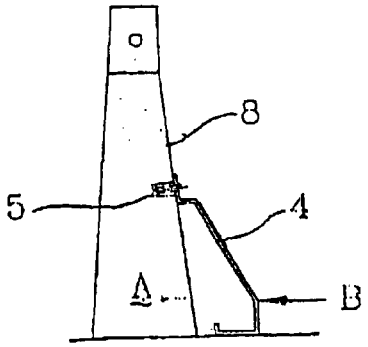
FIGS. 3 to 6 show different embodiments of a steel-made socle or dampening element B.

Following the natural order of the Figures, FIG. 3 suggests a solution in which the socle B is formed by a steel-made element with an open cross section 4, connected by bolts to bushes embedded in the concrete of the resistant element A. On its lower side, the steel-made element 4 is simply laid on the curbstone or road pavement, so as to promote the displacement and the deformation in the eventuality of a collision.

Figure 4:
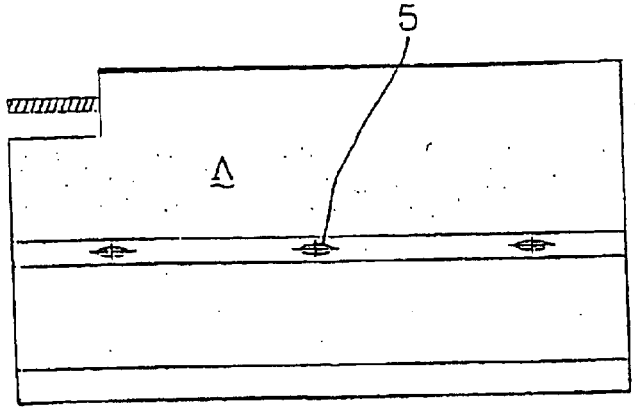

FIG. 4 shows the position of the bushes 5 (front view of the resistant element A taken alone, before assembling element B).

Figure 5:
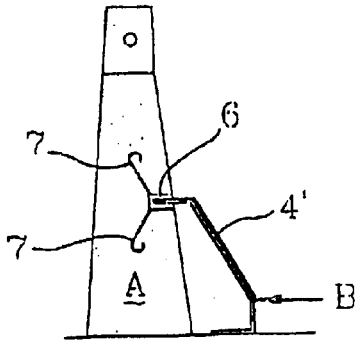

FIG. 5 shows a solution according to which, on its upper part, the steel-made and open-cross section element 4' is simply fitted, along separate portions, inside a discontinues groove of steel, the latter being obtained by means of prefabricated pieces 6, which are embedded inside the concrete of the element A. The pieces 6 may be provided with hooks 7 for anchoring them to the concrete material of element A.

Figure 6:
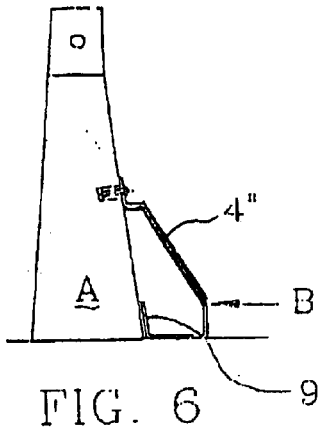

While in FIG. 3, the lower part of the steel-made element 4—having an open cross section—was not in contact with the the vertical wall 8 of the resistant element A, according to FIG. 6, the steel-made element 41 has a contact portion 9 with the vertical wall 8, and therefore will not give rise to a displacement or only to a very little displacement as compared with the element shown in FIG. 3, upon impact by a vehicle.

Figure 7:
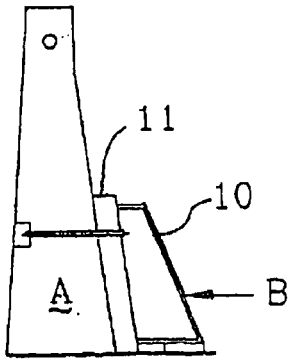
FIGS. 7 and 8 show different embodiments of a socle B made of concrete.
Figure 8:
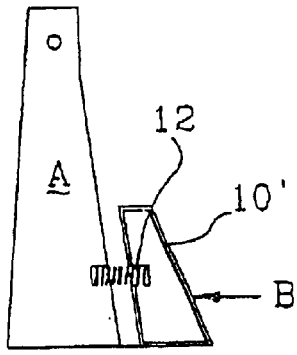

The embodiment of FIG. 7 shows on the other hand a socle B which is made of a concrete element 10 connected to A by means of bolts. In this case, the socle B is obviously not capable of deforming itself, and the dampening effect is provided by a dampening material 11, which may be polystyrene of a particularly specified density or another material with similar features. It goes without saying that the socle B must extend itself along the whole length of the relative module of the barrier (e.g. 6 meters), and the same holds, in the present embodiment, for the filling of the dampening material 11, even if a situation should not be excluded in which the latter is discontinuous to a sufficient amount for a better calibration of the decelerations. On the contrary, the dampening element of concrete 10', shown in FIG. 8, is connected with A by a dissipating means which is concentrated in certain points of element A, wherein the distance between said concentrated dissipating means 12 inserted in opposed cavities of A and B may be modulated according to the length of the barrier modules.

Examples of concentrated dissipating means are: helical steel-made springs, bundles or "packages" of entangled steel fibers as used on a different scale for earthquake-proof supports (not shown), etc.

Figure 9:
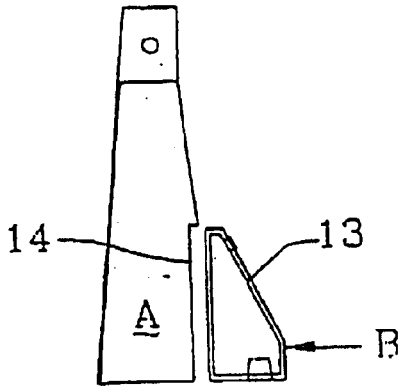
FIG. 9 is a cross section of an embodiment of socle B of the barrier, the socle being made of plastics.

A further class of dampening elements B is that of plastic made elements. In FIG. 9 there is shown an example of a socle B made of plastics, denoted by numeral 13, formed by a continuous trapezoidal element, inserted in the recess 14 of A. The impact is in this case dampened by the deformation of the element 13.

Figure 10:
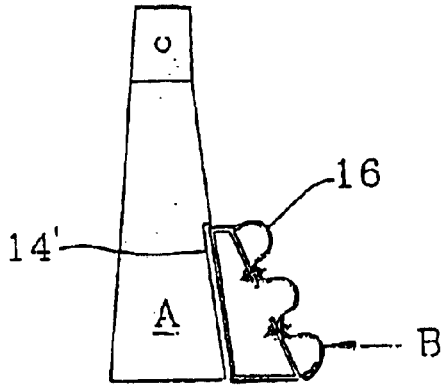
FIG. 10 is a cross section of a barrier with its socle B, the latter being formed by a triple wave connected by bolts to a plurality of trapezoidal sheet metal supports.
Figure 11:
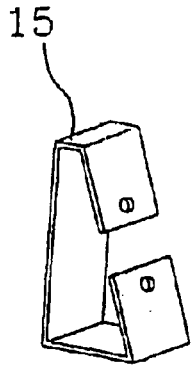
FIG. 11 is a perspective view of a sheet metal support used to support the triple wave.

In FIG. 10 there is shown a concrete made barrier having a socle B formed by a triple wave (of a kind usually employed for guardrails comprising posts and strips) which is connected by bolts to a plurality of supports of the type shown in FIG. 11. The trapezoidal supports (having an open shape) made of steel 15 may for instance be fitted every two meters in the recess 14' of the concrete made element A. The trapezoidal supports 15 will have an appropriate slope which facilitates the climbing or ascent of the automobile hitting the blade (strip). Obvioulsly, a strip formed by a double wave or of another kind may also be used.

This solution which utilizes the strips or blades usually employed for the guardrails including posts and strips, has the advantage of recycling materials which are already used.

The deformation of the blade or strip has the effect of diluting in time the transversal component, and allows at the same time the ascent of the vehicle. An obvious possible variant is that making use of a blade mounted vertically with respect to element A (not shown in the drawings).

Figure 12:
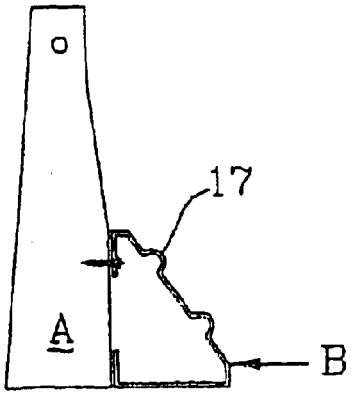
FIG. 12 is an embodiment analogous to that of FIG. 10, but including a shaped substantially trapezoidal sheet steel, forming a single draw piece (section)

FIG. 12 shows an arrangement including a socle made of steel having an open cross section, which has a special shape on the surface of impact, so as to be provided with stiffening ribs 17 obtained by drawing.

Figure 13:
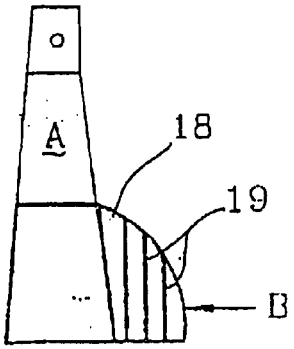
FIG. 13 is a barrier comprising a plastic made socle with longitudinal septa (separation walls)

FIG. 13 shows a solution wherein the socle 18 is formed by a plastic made dissipator with longitudinal dividing septa (walls) 19. The socle 18 may be formed by using rotational moulding of polyethylene or pulltrusion of polyester or another plastic material, which is then connected to spaced apart strips of fibers, disposed at distances of 1 or 2 meters from each other, and passing through a slit of the concrete made element A.

Figure 14:
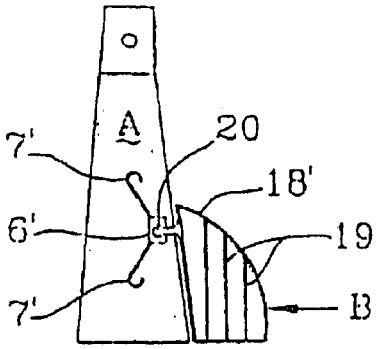
FIG. 14 is a barrier having a plastic made socle with longitudinal septa and restricted joint type connection.

FIG. 14 shows a socle which is identical to that shown in FIG. 13, but employing a restrained joint (obtained by a pressure action), including a bulb shaped part which is introduced inside an element analogous to the element 6 of FIG. 5. The bulb-shaped part 20 may be continuous or not.

It is obvious that the longitudinal septa 19 may be replaced by a different structure (a reticular or a honeycomb structure, etc.).

Figure 15:
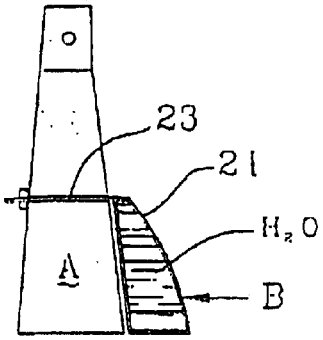
FIG. 15 is a barrier including a hollow type plastic made socle, filled with a mixture of water and sodium chloride.
Figure 17:
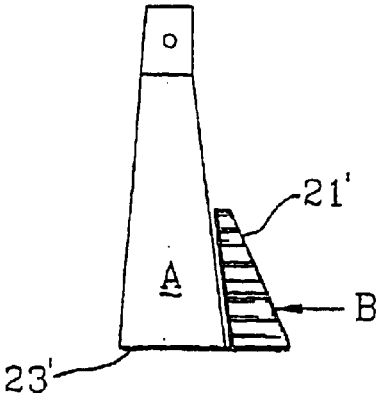
FIG. 17 is a second embodiment of a plastic made socle, filled with water and an antifreeze or salt, whose movements are restrained by the very weight of element A.
Figure 18:
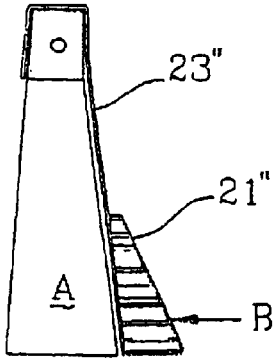
FIG. 18 is a third embodiment, including a plastic made socle B filled with water and an antifreeze, fixed to element A by means of a continuous strip of material which surrounds or hooks from above the upper part of element A.

An energy dissipator made of plastics, and without inner septa, filled with water and an antifreeze or salt, to prevent ice formation, in case of impact during the winter, is illustrated in FIGS. 15, 17, 18, and is indicated by the numerals 21, 21', 21" respectively.

So as to prevent the immediate compression of the water, the socle 21, 21' or 21" may be filled only partially with water and antifreeze or salt.

FIGS. 15, 17 and 18 differ from each other only with regard to the connection with the resistant element A.

Figure 16:
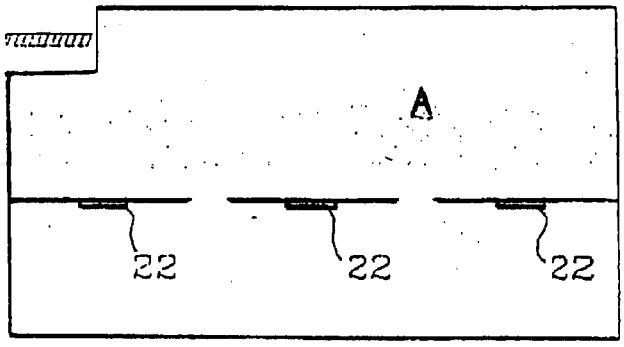
FIG. 16 is a front view of FIG. 15, omitting in the latter the socle B, and showing the holes for the introduction of the coupling means for securing the socle B to the element A, wherein the holes are obtained on element A.

In FIG. 15 the connection is made by inserting respective strips 23, e.g. of sheet steel, in the holes 22 of FIG. 16, and fixing in an appropriate way the strips 23 on the rear side of element A.

In FIG. 17 the strip 23', which may be continuous or point-like, welded (if of the same material) or connected to element 21', is disposed below A, which prevents its movement by its own weight. In FIG. 18 the connection strip passes over element A, and may comprise cat's eyes, if any. In case the strip is continuous, a protection of the concrete material from chemically aggressive agents which are present on roads is obtained at the same time.

It is obvious that possible combinations or variants of all embodiments of the socle which have been illustrated above, should not be excluded, with respect to features like the inner structure, the type of connection with element A, the use of slide shoes in case of a socle made of concrete, etc.

The calibration of the decelerations may therefore be obtained by varying the socle mass, or the type of connection with A, or else by providing a possibility of free displacement of the lower part of the socle (see FIGS. 3 and 5), etc.

Figure 19:
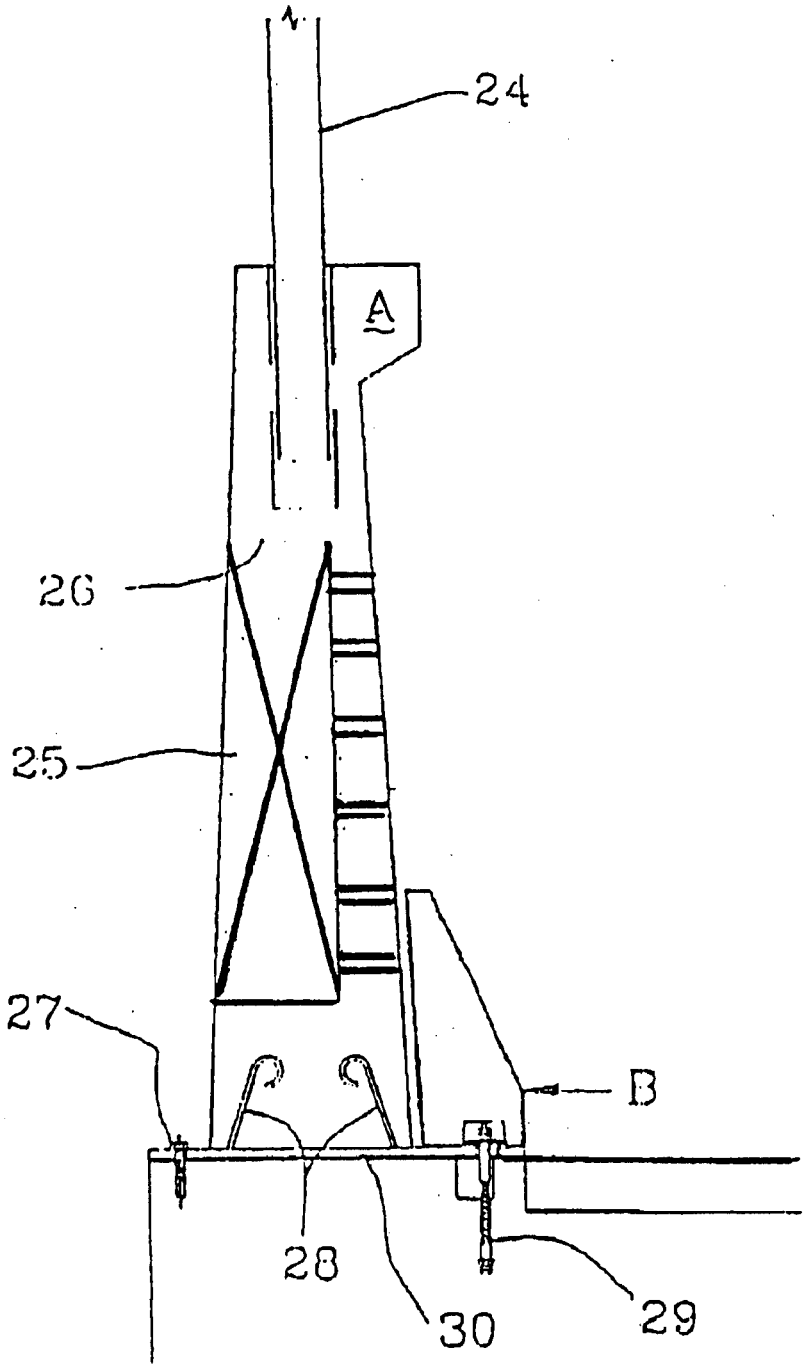
FIG. 19 is a cross section of a double effect barrier according to the invention, provided with a screen, noise absorbers, and anchor means in the form of ductile screw anchors, for the resistant element A.

FIG. 19 shows a variant of the barrier, for use as a screen support.

The screen 24 (e.g. a net for the protection against the throw of objects, a screen for sound insulation, or a windscreen) is mounted on the upper part of A, and has a known linear weight given in kg/m. Sound absorbers 25 (with a known linear weight) are arranged on the rear part of A, inside recesses 26. The element A is anchored to the curbstone, e.g. by means of ductile screw anchors 29 passing through the steel plate 30, the latter forming a single body or piece with the concrete of A.

Steel made connection means 28, provided on plate 30, and embedded during the casting of the concrete, ensure a reliable connection between the plate and the concrete of A. Anchor means which are more resistant and/or easier to realize, will be described later with reference to FIGS. 20–22.

Bolts 27 are used as rear anchor means against the force of the wind, and have a reduced resistance to shearing in order to allow the displacements following the impact. The screw anchors 29 on the opposite side have the same function too; moreover, they deform themselves in a controlled manner and have a predetermined resistance to breakage.

The resistant element A has—in the embodiment of FIG. 19—a large sized structure, and can support both the whole mass of the upper screen 24 and the above mentioned noise absorbers 25, which selectively absorb medium/low frequency noise. A crash test for type approval performed only having regard to the safety aspect, could be carried out with the sound absorbing parts simply simulated with respect to their mass and position; this allows to use barriers which, for what concerns those parts, are different from the point of view of their function as an acoustic insulation screen, but are identical with respect to their safety function.

FIGS. 20, 21, 22 show the details of other two types of connection means between the resistant element A and the curbstone or pavement, said means being embedded in the casting.

A U-shaped sheet steel 31 presents a slot 32 for the insertion of the screw anchor 29. Through the slits 34 of the U-shaped part, there passes a bracket 38 which is also U-shaped and which has two arms terminating in two hook portions 35, the latter engaging further brackets 37 and 37', embedded as reinforcements in the concrete of A whose boundary is denoted by dotted lines 33. The reinforced-concrete rods 36, 36' of the conventional reinforcement pass above the sheet metal 31. The disclosed connection realizes a chain of connections between the components 31 and 38 on the one hand, and, on the other, between 37, 37'.

The described connection system has the advantage that it does not require welded parts.

The number 33 denotes the boundary of the region occupied by the concrete of A.

The front portion 39 (which is located on the back side in the Fig.) of the sheet metal 31, projects beyond the foot of the concrete element A.

FIGS. 21 and 22 show another kind of connection, having the same function, but comprising welded parts. concerns those parts, are different from the point of view of their function as an acoustic insulation screen, but are identical with respect to their safety function. FIGS. 20, 21, 22 show the details of other two types of connection means between the resistant element A and the curbstone or pavement, said means being embedded in the casting.

A U-shaped sheet steel 31 presents a slot 32 for the insertion of the screw anchor 29. Through the slits 34 of the U-shaped part, there passes a bracket 38 which is also U-shaped and which has two arms terminating in two hook portions 35, the latter engaging further brackets 37 and 37', embedded as reinforcements in the concrete of A whose boundary is denoted by dotted lines 33. The reinforced-concrete rods 36, 36' of the conventional reinforcement pass above the sheet metal 31. The disclosed connection realizes a chain of connections between the components 31 and 38 on the one hand, and, on the other, between 37, 37'.

The described connection system has the advantage that it does not require welded parts.

The number 33 denotes the boundary of the region occupied by the concrete of A.

The front portion 39 (which is located on the back side in the Fig.) of the sheet metal 31, projects beyond the foot of the concrete element A.

FIGS. 21 and 22 show another kind of connection, having the same function, but comprising welded parts.

In this case the plate is formed by a box-like element 31', and the hook portions 35" which engage the additional brackets 37 and 37', are welded on the upper surface of the box-like element 31'. The components 31', 35' are embedded in the concrete of A. A slot 32' is formed both on the upper and the lower part of element 31' (see FIG. 21) and serves for the passage of the ductile screw anchor. The dotted line around the slot 32' denotes the washer for the abutting head (nut) of the screw anchor.

Turning again our attention to FIG. 20, a slide shoe for reducing friction with the curbstone or pavement, may be provided below the U-shaped raised part 31.

It is possible that the resistant element A will, in some cases, not include slide shoes or ductile anchor means for the connection to the support.

INDUSTRIAL APPLICABILITY

As has been already pointed out, the barrier may vary between classes of smaller resistance (H2) and those of maximum resistance (H4). According to Italian regulations, this means that the impact energy the barrier—according to its different embodiments—must be able to withstand, varies from 128 Kj for the H2 class, to 572 Kj or 724 Kj for the H4 class, depending on the vehicle type.

Moreover the barrier must prevent lorries from vaulting, wherein said lorries have a maximum height for their center of gravity which must not exceed about 1,60 meters. This means that the barrier must have excellent features in order to prevent vaulting and thereby to avoid very serious consequences not only to the passengers of the colliding vehicle, but also to possible railways, roads, buildings, etc. located below a bridge etc.

At the same time, the barrier must deform itself and be able to move backwards, so as to absorb the impact energy in a controlled manner.

Taking into account the fact that usually a large space is not available, the transversal movement of the barrier, which is in any case desirable, must always be restricted.

The measured components of the accelerations, must give rise to an ASI $$ASI=[(a_x/12)^2+(a_y/8)^2+(a_z/10)^2]^{1/2}$$

less or equal to one for normal use;

less or equal to 1.4 for the use on particularly dangerous bridges, e.g. barriers to be installed on the bridge side.

What is claimed is:

1. A road safety barrier, comprising:

a resistant element (A) designed to stop motion of heavy vehicles, said resistant element comprising two substantially vertical walls, each vertical wall with a foot and a seat; and at least one dampening element (B) inserted in and rigidly connected to the seat of said resistant element, said dampening element forming a socle at the foot of said resistant element and positioned on at least one side of said foot facing a carriageway, said dampening element comprising a dampening material which deforms itself upon impact of an automobile, said dampening element having a form that lifts a front part of the automobile, wherein said resistant element has a first resistance to impact and said dampening element has a second, lower resistance to impact, and wherein, said at least one dampening element comprises a continuous sheet steel with an open cross-section, the sheet steel has an upper part and a lower part, the upper part is fixed to said resistant element, and the lower part arranged adjacent the substantially vertical walls of the resistant element, the lower part non-fixedly contacts or is spaced apart from the vertical walls.

2. A road safety barrier, comprising:

a resistant element (A) designed to stop motion of heavy vehicles, said resistant element comprising two substantially vertical walls, each vertical wall with a foot and a seat; and at least one dampening element (B) inserted in and rigidly connected to the seat of said resistant element, said dampening element forming a socle at the foot of said resistant element and positioned on at least one side of said foot facing a carriageway, said dampening element comprising a dampening material which deforms itself upon impact of an automobile, said dampening element having a form that lifts a front part of the automobile, wherein said resistant element has a first resistance to impact and said dampening element has a second, lower resistance to impact, and wherein, the at least one dampening element forms a continuous strip shaped to include at least a double wave, and said strip is supported and connected with bolts to steel supports, said steel supports fitted at equal distances inside the seats of the vertical walls, said supports having an inclination to facilitate the lifting of the front part of the automobile.

3. A road safety barrier, comprising:

a resistant element (A) designed to stop motion of heavy vehicles, said resistant element comprising two substantially vertical walls, each vertical wall with a foot and a seat; and at least one dampening element (B) inserted in and rigidly connected to the seat of said resistant element, said dampening element forming a socle at the foot of said resistant element and positioned on at least one side of said foot facing a carriageway, said dampening element comprising a dampening material which deforms itself upon impact of an automobile, said dampening element having a form that lifts a front part of the automobile, wherein, said resistant element has a first resistance to impact and said dampening element has a second, lower resistance to impact, the at least one dampening element forms a continuous plastic socle internally stiffened by one of a reticular structure, a septa, and a honeycomb structure, and the continuous plastic socle is connected to the resistant element by at least one of a restrained joint (6',20) and a strip, the strip is one of a continuous strip and a discontinuous strip (23'), and the strip extends below the resistant element, or above the resistant element (23"), or through (23) the resistant element (A).

4. A road safety barrier, comprising:

a resistant element (A) designed to stop motion of heavy vehicles, said resistant element comprising two substantially vertical walls, each vertical wall with a foot and a seat;

at least one dampening element (B) inserted in and rigidly connected to the seat of said resistant element, said dampening element forming a socle at the foot of said resistant element and positioned on at least one side of said foot facing a carriageway, said dampening element comprising a dampening material which deforms itself upon impact of an automobile, said dampening element having a form that lifts a front part of the automobile, said resistant element having a first resistance to impact and said dampening element having a second, lower resistance to impact;

resistant element supports;

ductile screw anchors anchoring the resistant element to the resistant element supports, wherein, the resistant element comprises a lower steel plate (31, 31') with ductile screw anchors (29) for anchoring to a ground element; and a concrete reinforcement for the resistant element, the concrete reinforcement comprising a bracket (37) engaging two hooks (35, 35') connected on the lower steel plate.

* * * * *